US012104322B2

(12) United States Patent
Bjerke

(10) Patent No.: US 12,104,322 B2
(45) Date of Patent: Oct. 1, 2024

(54) METHOD AND A SYSTEM FOR A YANKEE CYLINDER IN A TISSUE MACHINE

(71) Applicant: Valmet Aktiebolag, Sundsvall (SE)

(72) Inventor: Michael Bjerke, Hammarö (SE)

(73) Assignee: VALMET AKTIEBOLAG, Sundsvall (SE)

( * ) Notice: Subject to any disclaimer, the term of this patent is extended or adjusted under 35 U.S.C. 154(b) by 153 days.

(21) Appl. No.: 17/622,421

(22) PCT Filed: Jun. 11, 2020

(86) PCT No.: PCT/SE2020/050607
§ 371 (c)(1),
(2) Date: Dec. 23, 2021

(87) PCT Pub. No.: WO2020/263157
PCT Pub. Date: Dec. 30, 2020

(65) Prior Publication Data

US 2022/0333307 A1 Oct. 20, 2022

(30) Foreign Application Priority Data

Jun. 26, 2019 (SE) ..... 1950788-8

(51) Int. Cl.
*D21F 5/18* (2006.01)
*D21F 7/00* (2006.01)
*D21G 9/00* (2006.01)

(52) U.S. Cl.
CPC ..... *D21F 5/181* (2013.01); *D21F 7/003* (2013.01); *D21G 9/0036* (2013.01)

(58) Field of Classification Search
CPC .. D21F 5/181; D21F 11/14; B31F 1/12; B31F 1/14; B31F 1/36; D21G 9/0036
See application file for complete search history.

(56) References Cited

U.S. PATENT DOCUMENTS 1,914,869 A 6/1933 Rowe
4,942,675 A 7/1990 Sundovist
(Continued)

FOREIGN PATENT DOCUMENTS

CN 106418645 A 2/2017
JP H04-316109 A 11/1992
(Continued)

OTHER PUBLICATIONS

International Searching Authority, International Search Report and Written Opinion for International Application No. PCT/SE2020/050607, dated Jun. 26, 2020, The Swedish Patent and Registration Office (Patent- och registreringsverket), Stockholm, Sweden.
(Continued)

*Primary Examiner* — Dennis R Cordray
(74) *Attorney, Agent, or Firm* — Alston & Bird LLP

(57) ABSTRACT

The invention relates to a method and system for improving the application of a coating on a Yankee cylinder (CR) in tissue paper machines. The invention implements a moisture-controlled environment (12) in an area of the exposed Yankee cylinder between the take-off position (TO) and ahead of the transfer position (TP) of the web, i.e. before and/or after the application of a coating with Performance Enhancing Material (PEM), wherein the cooling effect on the Yankee surface is increased by increased evaporation rate of water in the coating or water additionally applied onto the coating.

19 Claims, 9 Drawing Sheets

(56) References Cited

U.S. PATENT DOCUMENTS

| | | | | |
|---|---|---|---|---|
| 5,635,028 | A | 6/1997 | Vinson et al. | |
| 5,944,958 | A | 8/1999 | Svanqvist | |
| 8,608,904 | B1 | 12/2013 | Tucker et al. | |
| 9,388,530 | B2 | 7/2016 | Von Drasek et al. | |
| 2003/0119412 | A1 | 6/2003 | Sayovitz et al. | |
| 2004/0060675 | A1 | 4/2004 | Archer et al. | |
| 2004/0177940 | A1 | 9/2004 | Archer et al. | |
| 2010/0086672 | A1 | 4/2010 | Von Drasek et al. | |
| 2013/0078364 | A9 | 3/2013 | Von Drasek et al. | |
| 2014/0096925 | A1 | 4/2014 | Gorden | |
| 2014/0170302 | A1* | 6/2014 | Von Drasek ..... | D21G 9/0045 427/9 |

FOREIGN PATENT DOCUMENTS

| | | | |
|---|---|---|---|
| JP | 2010-077590 | A | 4/2010 |
| JP | 2012-505322 | A | 3/2012 |
| JP | 2014-084533 | A | 5/2014 |
| JP | 2014-173200 | A | 9/2014 |
| JP | 2017-025439 | A | 2/2017 |

OTHER PUBLICATIONS

Extended European Search Report for European Patent Application No. 20833511.7, dated Jul. 19, 2022, (9 pages), European Patent Office, Munich, Germany.

Office Action for Japanese Patent Application No. 2021-577131, dated Oct. 1, 2023, (11 pages), Japan Patent Office, Tokyo, Japan.

* cited by examiner

METHOD AND A SYSTEM FOR A YANKEE CYLINDER IN A TISSUE MACHINE

CROSS REFERENCE TO RELATED APPLICATIONS

This application is a National Stage Application, filed under 35 U.S.C. § 371, of International Application No. PCT/SE2020/050607, filed Jun. 20, 2020, which international application claims priority to and the benefit of Swedish Application No. 1950788-8, filed Jun. 26, 2019; the contents of both of which as are hereby incorporated by reference in their entireties.

BACKGROUND

Related Field

The invention relates to a method and a system for a Yankee cylinder in a tissue machine.

In tissue machines, a paper grade with high bulk qualities is produced where the tissue web is deliberately creped. i.e. not a plain paper. The fibrous web produced may be used as, for example, kitchen towel, toilet paper or facial tissue. In sharp contrast to production of paper where the paper should have high density and printable surface, the tissue paper should have optimal absorption and most often using creping technique of the web during production of the web.

The creping effect on the tissue web may be obtained by rush transfer between successive rolls where a speed difference between these successive rolls cause a creping effect on the tissue web. The creping effect may alternatively or additionally be obtained by using a doctor blade on a Yankee cylinder.

Due to the high bulk content, the tissue web is prone to web breakage during production, and especially during final drying on a creping roll, hereinafter identified as a Yankee cylinder. In order to improve transfer of the tissue web onto the Yankee cylinder, and to improve take off from the Yankee after final drying, a coating package is regularly applied onto the surface of the Yankee. This coating package is often referred to as a Performance Enhancing Material (PEM) and applied as a water solution of a multitude of additives. Some additives improve tissue web transfer to the Yankee and establish an increased tacky surface which the tissue web adhere to, and some additives improve take off and are grouped as release agents. Besides these main functions for improved transfer to the Yankee and improved take-off from the Yankee additional additives may be added for different purposes.

RELATED ART

Different solutions have been proposed in order to control the temperature profile on the Yankee cylinder or adjusting the application of crepe facilitating composition coatings on the Yankee cylinder.

A machine for manufacturing structured soft paper is disclosed in U.S. Pat. No. 4,942,675. In this concept, heated air is introduced at the very edges of the Yankee cylinder and suction openings are arranged over the width of the Yankee cylinder. Introduction of heated air reduces the cooling effect and reduces the power consumption for heating the Yankee. A tissue machine with water cooling nozzles cooling the outer ends of the Yankee is disclosed in CN106418645. These cooling nozzles are regulated such that the bulk temperature of the Yankee keeps the same.

A gap control for press bonding a web to a Yankee cylinder is disclosed in JP2014173200. The gap between the press roll and the Yankee is regulated by air nozzles arranged in the width direction of the Yankee, and the gap between the Yankee and the press roll, or thickness of the web, is controlled by cooling a part of the press roll needing thickness adjustment.

Several performance enhancing materials to be applied as a coating on Yankee cylinders have been proposed to improve production capacity in tissue machines.

In U.S. Pat. No. 5,635,028 a specific crepe facilitating composition is disclosed with about 0.02-1% bonding inhibitor such as a quaternary ammonium compound, and about 0.02-0.5% water soluble carboxymethyl cellulose, and about 0.05-3% cationic starch.

In U.S. Pat. No. 8,608,904 yet another specific crepe facilitating composition is disclosed, comprising about 0.1-70% oxidized polyethylene, and about 40-99% water. The oxidized polyethylene is emulsified in the liquid; and applied to the surface of the Yankee cylinder, and the fibrous web is transferred against the surface of the Yankee cylinder thereby causing sheet transfer and adhesion of the fibrous web to the surface of the Yankee cylinder.

These two patents are only examples of the intense development made in recent decades as of development of the performance enhancing materials applied to Yankee cylinders.

A method and an apparatus for monitoring and controlling the application of PEM to Yankee cylinders are disclosed in U.S. Pat. No. 9,388,530. After the take-off position, i.e. after the doctor blade, an additional cleaning blade acts on the bare surface of the Yankee cylinder. The application of the coating, i.e. PEM, is controlled by measuring the thickness of the coating anywhere between the doctor blade and the position where the web is pressed on the Yankee cylinder.

In summary, the above indicated prior art discloses the intense development finding a system and design of the transfer system between preceding web rolls (or felts) and the subsequent Yankee cylinder. The system must have a transfer surface with a surface that both provide for proper adherence of the tissue web onto the Yankee cylinder, and proper release of the tissue web from the Yankee cylinder. These two contradicting requirements, i.e. adherence and release, often lead to a very narrow operating window for the Yankee cylinder, where type of PEM as well as thickness thereof and temperature profile on the Yankee cylinder all have an impact on the final result.

BRIEF SUMMARY

Basic Terminology

Tissue Paper Grades

The invention is primarily intended for such tissue paper grades that have a basis weight in the range of 10 g/m$^2$-30 g/m$^2$ but in some cases, it can be used also for tissue papers with even lower weight, e.g. down to 7 g/m$^2$. Normally, it would be used for tissue papers with a basis weight in the range of 14 g/m$^2$-28 g/m$^2$. The indicated ranges for basis weight refer to the weight of the ready-dried web, i.e. the basis weight of the tissue paper that is rolled to a tissue paper roll on a reeling drum receiving the tissue web from the Yankee cylinder. Producing tissue grades as indicated above is more difficult compared to ordinary paper grades as the tissue web is more vulnerable for web breaks during production.

Yankee Cylinder

The Yankee cylinder, or alternatively a creping roll, is used as a drying cylinder and is heated internally by pressurized steam reaching surface temperatures in the range 130-140° C. The web is often additionally heated/dried externally by a hood where hot air is supplied at temperatures in the range 300-500° C. This establish an elevated temperature around the entire Yankee cylinder with a high humidity as water is continuously evaporated from the web.

The Yankee cylinder typically reaches peripheral speeds, i.e. the speed of the web, in the range of 800 up to 2200 m/minute.

Coating Package, i.e. PEM

In the following, performance enhancing material is abbreviated as PEM, and supplied as a water solution with different polymeric materials such as polyethylene (PE), polyvinyl alcohol (PVOH) such as Selvol 540 or Selvol 523 grades, Polyamide Epichlorohydrin resin (PAE), non-PAE based resins, glycol based resins, or other polyols as main additive in the PEM applied. These compounds are applied to control tackiness of the web improving proper adherence of the web to the Yankee at the transfer position. The coating package, i.e. the PEM, may also contain release agents improving take off by the doctor blade, using glycol based release agents, mineral oil based release agents, vegetable oil-based release agents and other additives like Latex and polyols/humectants. That invention is suitable for any systems involving either of these materials alone or in combination as part of the PEM, i.e. the coating package.

Creping Effect

The creping effect induced in the web may be obtained while transferring the web onto the Yankee cylinder or alternatively or additionally during take-off of the web from the Yankee cylinder.

A first order of crepe may be induced by rush transfer from preceding felts or roll and onto the Yankee cylinder. The Yankee cylinder running at a lower speed than the preceding felts or roll and a speed difference in the range 2-25% (RT %). A second order of crepe may be induced by a doctor blade taking the web off the Yankee cylinder.

The Invention

The invention is based upon the finding that the effect of a PEM coating on the surface of a Yankee cylinder may be improved if the PEM coating is prevented from overheating and turn into a glassy state after application of the PEM coating on the Yankee cylinder.

The best cooling effect is obtained from evaporative cooling, and the invention improves the evaporative cooling of the PEM coating by evaporating water from the PEM coating per se, and optionally by evaporating additional water that is applied onto the PEM coating as such or the Yankee surface before application of the PEM coating.

If the normal environment is kept in the area between the take-off position and the transfer position (i.e. the area which, in the direction of rotation of the Yankee cylinder, extends from the take-off position to the transfer position), then the moisture level would lie in the range 80-100% at high temperatures, and this result in reduced evaporation rate of water from the PEM. By replacing the typical high moisture environment around the heated Yankee, at some 80-100% moisture level, with a low moisture environment at 60-80% moisture level, could evaporation rate and thus cooling be improved.

The invention increases dehydration rate by increasing flux of energy by replace air with high moisture by fresh air with lower moisture content in the environment, which increases dehydration rate of coating layer and any additional water applied.

Additional cooling of the PEM coating, or additional cooling of the Yankee cylinder surface directly in front of application of the PEM coating, may keep the PEM coating at lower temperature and thus avoiding viscosity losses that results in more of the PEM coating diffusing into the web rather than being kept on the surface of the Yankee cylinder.

There a several problems that are solved with the improved cooling of the PEM coating:

roll uniformity (equal diameter in take-up roll)

Improved tackiness of the PEM coating in the transfer position, improving safe transfer and less web-breaks over time (cooling prevents PEM to become glassy, i.e. no longer tacky):

Improved release of the web in the take-off position, improving safe transfer and less web-breaks over time:

Less consumption of PEM, reducing operating costs (cooling prevents release agents in PEM to penetrate the web due to low viscosity and end up in the take up roll, which will decrease the residual amount of PEM on the Yankee surface after take-off and increase need to add new fresh PEM on the Yankee);

Improved hygiene around Yankee area by reduction of deposits of fiber and chemicals being brought by steam from accumulating on the frame underneath the Yankee and other equipment nearby.

All above problems are solved or objectives improved using a simple replacement of the air between the take-off position and the transfer position with air from the machine hall that has a temperature of about 25° C. and a moisture content of about 60%. The improvement may be improved further if the replacement air is further cooled and dehumidified.

The inventive method is related to controlling the application of a coating (i.e. to improve the effect/effectiveness of the application of a coating) containing a water solution of a Performance Enhancing Material (PEM) on a surface of a Yankee cylinder ahead of the Transfer Position (TP) of a tissue web onto the Yankee cylinder comprising:

(a) taking off the dried and creped tissue web (W) from the Yankee cylinder (CR) in a take-off position (TO);

(b) establishing at least one moisture-controlled environment in the area which, in the direction of rotation of the Yankee cylinder, lies between the take-off position (TO) and the Transfer Position (TP) of the tissue web onto the Yankee cylinder, the moisture-controlled environment preferably being shielded from the application position (TP) of the Performance Enhancing material (PEM) onto the Yankee cylinder, c) lowering the relative humidity in the moisture-controlled environment;

(d) cooling the surface of the Yankee cylinder in the moisture-controlled environment by increasing evaporation rate of water in or applied onto the Performance enhancing material.

That the relative humidity in the moisture-controlled environment is lowered preferably means establishing a relative humidity that is at least 20%-units (percentage units) lower than the relative humidity established in this environment without having any moisture-controlled environment.

Application of this method greatly improves the effectiveness of the performance enhancing material and increases the operating window for successful transfer and take-off at higher speeds of the Yankee cylinder, thus increasing production capacity. Further, this cooling also results in more even diameter in the take up roll following the Yankee cylinder, i.e the ultimate evidence of a better and more even application of the performance enhancing material.

Controlling the ambient moisture is a way of affecting/influencing the speed of evaporation and the temperature of the coating film. This can be done by means of, for example, heat transfer to the ambient air or by blowing dry air. The coating film will be subjected to drying ahead of the transfer position and obtain a lower temperature. Thereby, the positive effect can be achieved that the coating film will have a higher viscosity at the transfer position and the coating film will become more tacky. Moreover, less coating film will be absorbed by the tissue paper sheet. This does not presume that all water from the PEM coating is evaporated before the film reaches the transfer position since the heat from the Yankee will raise the temperature of the film regardless of whether there is a controlled environment or not. In some zones, the film may become overheated and too dry (which may decrease viscosity and tackiness). To counteract this, moisture can be increased locally by the addition of liquid coolant such that the temperature and the speed of evaporation are reduced.

In a preferred embodiment of the inventive method, the moisture-controlled environment is shielded from the application position (TP) of the Performance Enhancing Material (PEM) onto the Yankee cylinder. In this way the cooling environment may be prevented from interfering with a successful application of an even layer of the Performance Enhancing material.

Further, the moisture-controlled environment is preferably shielded on at least 3 sides of the moisture-controlled environment and said moisture-controlled environment open towards the exposed outer cylindrical surface of the Yankee cylinder. This enclosure of the moisture-controlled environment may direct the cooling effect to the exposed outer cylindrical surface of the Yankee cylinder.

In a preferred implementation the cooling may be obtained by adding a first coolant into the moisture-controlled environment. The cooling effect may thus be controlled by controlling the rate of supply of the coolant, using simple control valves, either manually operated or with closed loop control.

In the simplest implementation of the method, the coolant used may be air blown into the moisture-controlled environment. Air has the advantage of no introduction of additional liquids or layers ahead of application of the coating and may assist in further removal of web residues that is left even after having passed the doctor blade and any cleaning device.

Alternatively, the inventive method may use a second coolant in form of a liquid coolant applied onto the outer cylindrical surface of the Yankee cylinder, which liquid coolant is evaporated in said moisture-controlled environment after being applied onto the outer cylindrical surface of the Yankee cylinder ahead of the moisture-controlled environment.

The liquid supply may be regulated to such small amounts that any liquid residues are well evaporated before application of the coating. The cooling liquid supplied should be readily evaporated when contacting the surface of the Yankee cylinder. If for example water is used as the coolant, this water may be heated close to its evaporation temperature, i.e. close to about 100° C. at ambient pressure, allowing rapid evaporation upon contact with the heated surface of the Yankee cylinder. Alternatively, more extreme cooling liquids may be used such as liquid nitrogen having a boiling point at −195.79° C. But any cooling liquid may be used with an evaporation temperature below the temperature of the surface of the heated Yankee cylinder. Hence a cooling liquid with an evaporation temperature in the range from −200° C. up to about +100° C. may be used. The cooling liquid may be applied as a mist by pressurized nozzles.

In yet a further embodiment of the inventive method according at least two different coolants may be used in the moisture-controlled environment in at least two different zones of the moisture-controlled environment. This may be realized as either two independent air-cooled zones or two or three successive cooling zones using liquid and/or air in any order in these zones.

According to a further embodiment the coolant may be distributed over the entire width of the Yankee cylinder. This is recommended because the temperature profile over the entire width should be as even as possible in order to obtain uniform application of the coating over the entire width.

This distribution of the coolant may be distributed over the entire width of the Yankee cylinder using multiple nozzles arranged over the entire width of the Yankee cylinder. Preferably also each nozzle may be individually adjustable.

As an alternative to the usage of multiple nozzles, the coolant may be distributed over the entire width of the Yankee cylinder using a slot arranged over the entire width of the Yankee cylinder. Preferably the slot gap may also be adjustable.

In yet an alternative embodiment of the inventive method, the temperature on the surface of the Yankee cylinder is measured after the moisture-controlled environment and the coolant supply is controlled in order to reach a target temperature. If this temperature detection is made on a narrow strip of the total width of the Yankee cylinder, then the associated individual cooling nozzle, cooling the narrow strip, may be controlled accordingly. Preferably the number of temperature sensors may be the same as the number of cooling nozzles, such that each temperature sensor detects the temperature established by one nozzle.

The temperature in the moisture-controlled environment is preferably lowered at least 20° C. compared to not using a moisture-controlled environment, and preferably establishing a temperature of the moisture-controlled environment within the range 20-80° C.

In order to implement the inventive method described in preceding paragraphs an inventive application system may also be used.

The inventive system of controlling the application of a coating (i.e. for improving the effect/effectiveness of the application of a coating) containing a Performance Enhancing Material on a surface of a Yankee cylinder ahead of the transfer position of the web onto the Yankee cylinder may comprise:

(a) a doctor blade (10) taking off the dried and creped web (W) from the Yankee cylinder (CR) in a take-off position (TO);

b) an application position (TP) of the Performance Enhancing Material (PEM) onto the Yankee cylinder arranged after the take-off position;

(b) arranging at least one moisture controlled environment in the area which, in the direction of rotation of the Yankee cylinder, extends from the take-off position (TO) to the transfer position (TP) of the tissue web onto the Yankee cylinder by supplying low moisture air from a low moisture air source to the moisture controlled environment;

(c) said moisture-controlled environment establishing a reduced relative humidity, preferably a relative humidity that is at least 20% percentage units lower than the relative humidity established in this environment without having any moisture-controlled environment;

(d) cooling the surface of the layer of Performance Enhancing Material (PEM) applied onto the Yankee cylinder in the moisture-controlled environment by increasing evaporation rate of water in or applied onto the Performance enhancing material.

Further, in the inventive system the moisture-controlled environment is preferably shielded from the application position (TP) of the Performance Enhancing Material (PEM) onto the Yankee cylinder using at least one shield wall (13*a*/13*b*) located with one end of the shield wall (13*a*/13*b*) close to surface of Yankee cylinder, at a short distance (d), and the other end of the shield wall at a remote distance (d) exceeding 5 centimeters from the Yankee cylinder.

The distance between the one end of the shield and the surface of the Yankee cylinder may be set at a minimum clearance such that the end of the shield does not risk coming into contact with the surface of the Yankee cylinder. Alternatively, a flexible seal may be arranged at the end of the shield.

The shield wall may also be extended in the inventive system such that the moisture-controlled environment is shielded on at least 3 sides of the moisture-controlled environment by shield walls and said moisture-controlled environment open towards the exposed outer cylindrical surface of the Yankee cylinder. The moisture-controlled environment may thus be contained in box-like arrangement, avoiding coolant to flow in the lengthwise direction of the running web to parts of the machine not needing cooling. The box-like arrangement may also be closed in the transverse direction of the running web, with one low-moisture air inlet in one wall and a ventilating outlet in the other opposite wall.

In the inventive system, the low moisture air source ($Air_1$, $Air_2$) is air taken from the machine hall of the Yankee cylinder or air taken externally from the machine hall of the Yankee cylinder. This air may be sucked in from ambient surrounding via filters and possible cooling devices if the temperature of ambient air is somewhat high, and/or via dehumidifying system before usage. External outside air may be drawn in from the surroundings of the machine hall, or alternatively drawing in air from the machine hall if that is sufficiently tempered and dry.

As an alternative or complement in the inventive system, a second coolant source is a liquid coolant, preferably water, that is applied on the surface of the Yankee cylinder before the application position of the Performance Enhancing Material (PEM) onto the Yankee cylinder said liquid coolant increasing the volume of evaporable liquid in the residual layer of Performance Enhancing Material (PEM) left on the Yankee after the doctor blade. The residual PEM layer has been heated and may be close to a glassy state, and application of water on such residual PEM layer can prevent the residual layer from becoming glassy and maintain a tacky consistency, as the applied layer of water is starting to evaporate and maintain a temperature of 100° C. as long as water is left on the surface.

Alternatively, liquids with lower boiling point, below 100° C., such as alcohols or liquified gases may be used as the second coolant source.

As yet an alternative or complement in the inventive system, a second coolant source is a liquid coolant that is applied on the surface of the Yankee cylinder after the application position of the Performance Enhancing Material (PEM) onto the Yankee cylinder, said liquid coolant increasing the volume of evaporable liquid in the Performance Enhancing Material (PEM) applied. The addition of a water layer upon the fresh PEM layer may be done at a distance from the position of applying the PEM layer, and in a position when the original water content of the PEM layer has dropped. Additional application of water will extend the distance where the applied fresh PEM layer, that is applied on top of the residual PEM layer, could maintain such high amount of water that the temperature is kept below 100° C. in the PEM layer.

In special circumstances when there is sufficient available space between the take-off position and the transfer position, i.e. the circumferential part of the Yankee cylinder with no web on the surface, at least two different air or coolant sources could be used in at least two different zones of the moisture-controlled environment. This multiple arrangement may offer to use for example a first zone using liquid coolant from a first coolant source and a second cooling zone using air as coolant from a second coolant source.

In a further embodiment of the inventive system, at least one evacuation zone may be used in the moisture-controlled environment, evacuating evaporated moisture from the Performance Enhancing Material through an extraction pipe. If such an evacuation pipe is used residual liquid coolant may be further evaporated and extracted from the surface of the Yankee cylinder, thus increasing the total cooling effect.

In the inventive system, the coolant is preferably distributed over the entire width of the Yankee cylinder by a cooling boom. This kind of distribution device may ensure equal distribution over the entire width of the Yankee cylinder. The coolant may preferably be distributed over the entire width of the Yankee cylinder using multiple nozzles on said cooling boom and in a more advanced option each nozzle may be adjustable by a control system in order to reach a target temperature. However, the multiple nozzle arrangement may also use simple drilled holes in a pipe used as the distribution boom. Alternatively, the multiple nozzle option the coolant may be distributed over the entire width of the Yankee cylinder using a cooling boom with a continuous slot arranged over the entire width of the Yankee cylinder. Preferably the slot gap may be adjustable by a control system in order to reach a target temperature.

In the inventive system, also the supply of the coolant may be controlled in a closed loop. The system may therefore include temperature sensors arranged after the moisture-controlled environment and before the application position of the Performance Enhancing Material (PEM), measuring the temperature on the surface of the Yankee cylinder having passed the moisture-controlled environment. Hence, the evaporation rate in the moisture-controlled environment may be controlled by a control system in order to reach a target temperature.

Alternatively, the system may include a temperature sensor arranged after the moisture-controlled environment and after the application position of the Performance Enhancing Material (PEM), measuring the temperature on the fresh PEM coating applied on the surface of the Yankee cylinder having passed the moisture-controlled environment. Both the PEM coating as well as evaporation rate may be controlled by a control system in order to reach a target temperature.

Above examples of the inventive method and system define the essential novel features in and around the Yankee cylinder and may of course be combined with other additional functionality in and around the Yankee cylinder, as well as any kind of web handling systems ahead of the Yankee cylinder or any kind of web take-up rolls after the Yankee cylinder. The essence of the invention lies in a novel application of a cooling zone or zones stretching over the entire width of the surface of the Yankee cylinder, which cooling zone increase evaporation rate of liquids in the PEM coating, such as the water content, or liquids applied on the fresh or residual PEM coating.

DETAILED DESCRIPTION OF VARIOUS EMBODIMENTS

Figure 4:
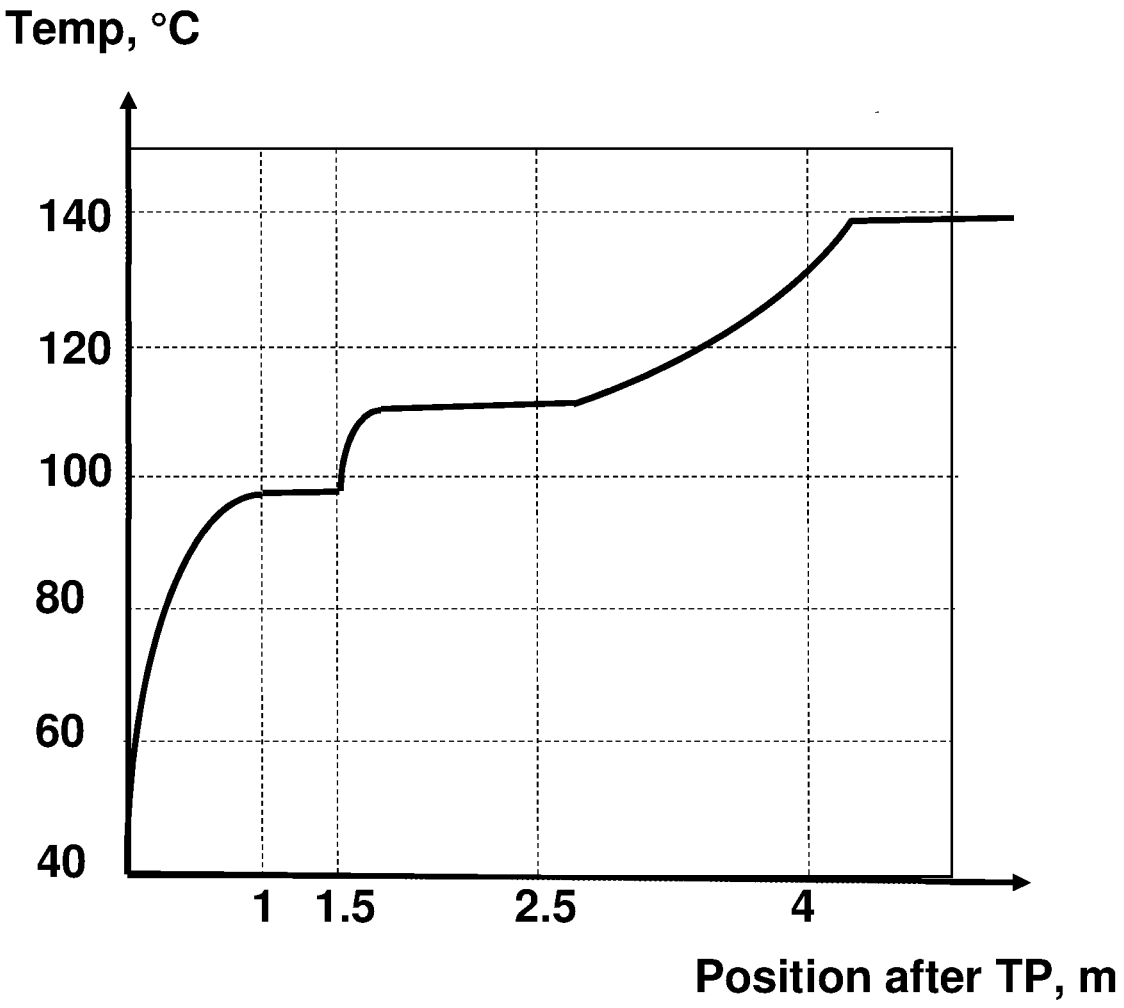
FIG. 4; shows schematically the temperature profile on the tissue web from the transfer position and 5 meters after the transfer position.

Before describing the invention, reference is made to FIG. 4 in which the typical tissue web temperature profile is shown. Conventionally the temperature of the tissue web transferred to the Yankee cylinder is about 40° C. and with a moisture content of about +40%. As seen here, the temperature of the web increases rapidly from the transfer position from about 40° C. to about 98-99° C., within 1 meter from the transfer position, wherein the bulk part of moisture is evaporated. As long as there is water enough to evaporate, the temperature will be kept roughly constant, as the evaporation per se chills of the web, preventing further heating of the web from the hot Yankee cylinder. The insight in this well-known temperature profiling indicates that the layer on the hot Yankee, in this case the paper web, may be kept below 100° C. as long as there is enough water in the layer being subject to evaporation.

After about 1.5 meters from the transfer position, the paper web is heated further as most moisture is gone, and thus evaporation of water could not reduce temperature increase of the web. After about a further 0.3-0.5 meters a second constant temperature zone is established, but after some 2.7-2.8 meters from the transfer position, the temperature of the web is increasing again and reaches a final temperature close to the temperature of the Yankee cylinder surface, i.e. about 140° C., and a final moisture content of less than 5%.

In this example, the Yankee cylinder is obtaining a dry tissue web within about an angle of wrap $\alpha$ corresponding to a about 4.5 meter of the circumferential length of the Yankee cylinder. The actual circumferential length that the web needs to be applied on the Yankee cylinder naturally depends upon the speed of the web, i.e. production capacity. With a typical speed of about 1500 m/minute the angle of wrap should increase proportional to speed increase, using same conditions in the tissue machine, and in such set-up the wrap angle should increase about ⅓ if web speed is increased from 1500 to 2000 m/minute. However, such reconfiguration of the tissue machine is costly due to major rebuild requirements for rolls, and therefore are instead drying conditions altered, for example by increasing temperature of the Yankee cylinder and/or in the hood.

Figure 1:
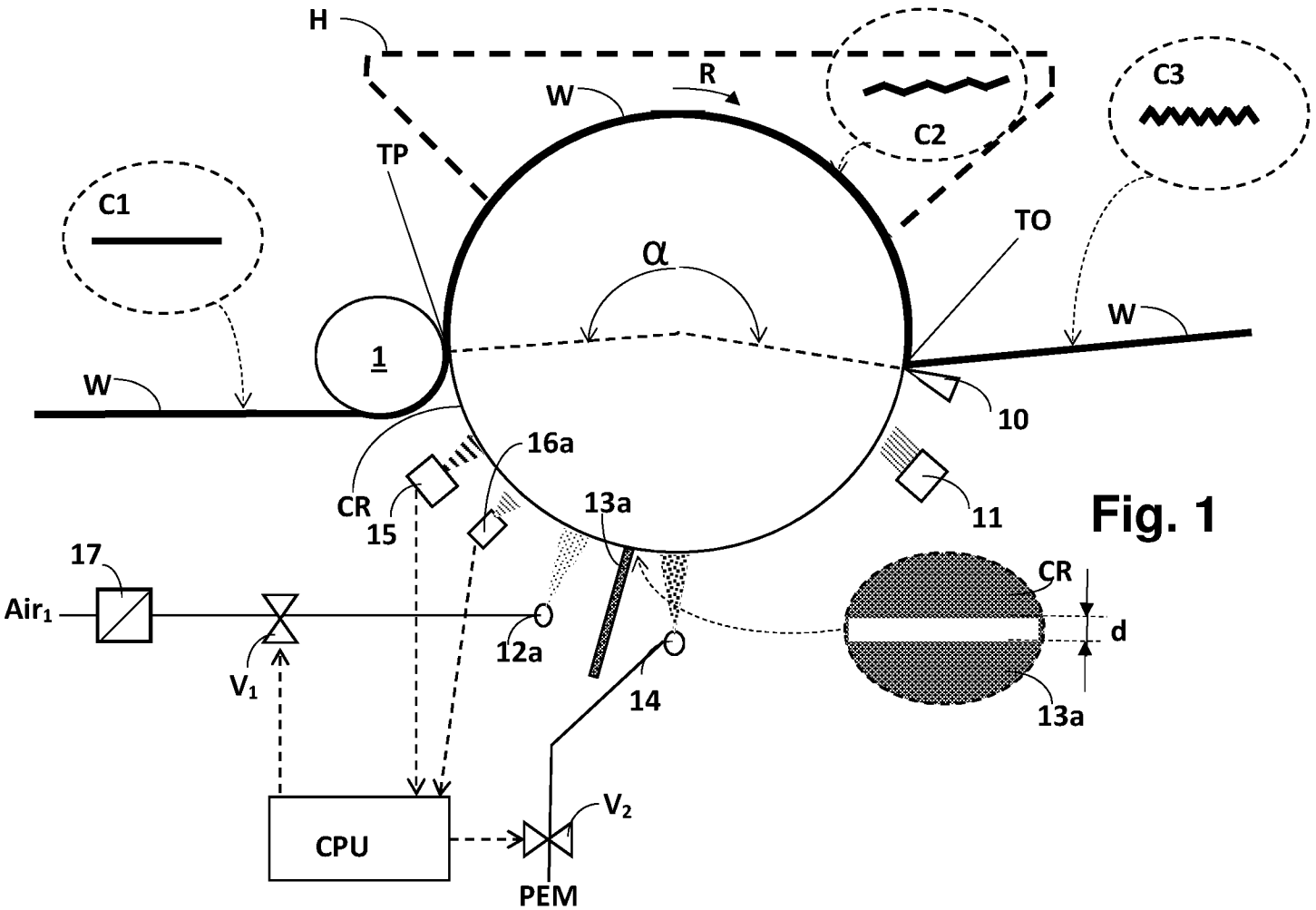
FIG. 1; shows a schematic side view of a first embodiment of the invention where a tissue web is fed to a Yankee cylinder in a transfer position and removed from the Yankee cylinder in a take-off position with cooling of the PEM coating after application of the coating.

In FIG. 1 a first embodiment of the invention is shown. The invention is related to the Yankee cylinder CR and using this Yankee cylinder to obtain a creped web product. As indicated in positions C1, C2 and C3 the web may be conveyed to the Yankee cylinder CR as a plain web W as shown schematically in C1. The web W is transferred to the surface of the Yankee cylinder CR by a transfer roll 1 in a nip in a transfer position TP.

If this transfer is done during a relative speed difference, i.e. a lower speed of the Yankee cylinder, a first order of crepe effect could be obtained in the web W as schematically shown in C2. However, a first crepe effect may also be obtained in preceding transfer nips ahead of the transfer to the Yankee cylinder.

The web runs over the surface of the Yankee cylinder CR at an angle of wrap $\alpha$ that may be in any order of 100-270°, and as shown in this figure in an order of wrap at about 190-200°. The web is conventionally dried as the Yankee cylinder CR is heated internally by pressurized hot steam. At the end of the angle of wrap, the finally dried web is taken off in a take-off position TO by a doctor blade 10. This doctor blade may induce yet an additional creping effect, increasing the crepe as schematically shown in C3. As indicated in FIG. 1 a hood H may also be provided that further heats the web with hot air.

After the doctor blade 10, as seen in the rotational direction R of the Yankee cylinder, an additional cleaning device 11 may be arranged, which cleaning device release any residual fibers from the Yankee cylinder. The cleaning device may be an additional doctor blade, or any brush like cleaning device.

After the cleaning device a PEM supply boom 14 is arranged. The PEM mixture is thus applied on the Yankee cylinder, allowing the coating to spread out evenly on the Yankee cylinder. Typically, the PEM mixture is cooled and as it contains a lot of water the coating mixture will maintain a temperature less than 100° C. as long as water may evaporate.

Now, according to the invention a low moisture air boom 12*a* is arranged after the PEM supply boom 14, as seen in the rotational direction R of the Yankee cylinder. This low moisture air boom 12*a* is connected to a low moisture air source $Air_1$, and with a control valve $V_1$ arranged in the supply pipe connected to the low moisture air boom 12*a*. The flow of low moisture air is preferably passing through a conditioner 17 where the coolant is chilled and dried. This creates a moisture-controlled environment cooling the exposed PEM coating by increased evaporation rate of the water content of the PEM coating.

A shield wall 13*a* is preferably arranged ahead of the moisture-controlled environment, with the end part located at a short distance d between the Yankee cylinder CR surface and the end part of the shield wall. The purpose of using a shield wall is to reduce any impact between the application of the PEM coating and any turbulence or air flow in the moisture-controlled environment. Said distance d may be set to any suitable range between 0.1 to 4 millimeters.

The expression moisture-controlled environment is hereinafter used to define a zone where the moisture level close to the web may be lowered considerably in comparison to the moisture level that is established by a not using a moisture-controlled environment. The temperature in the moisture-controlled environment may preferably be lowered from about 80-130° C. down to at least 40° C., or in the range 20-60° C., and hence a minimum reduction of the temperature of at least 20° C.

A temperature sensor 16*a* may be arranged after the cooling boom 12*a*. This temperature sensor may preferably be connected to a control unit CPU that may control the supply of the low moisture air by regulating the control valve $V_1$.

Finally, after the application of the PEM coating a thickness sensor 15 may also be arranged, that may detect the thickness of the coating applied. This thickness sensor 15 may preferably be connected to the control unit CPU that may control the supply of the PEM coating by regulating the control valve $V_2$.

Figure 2:
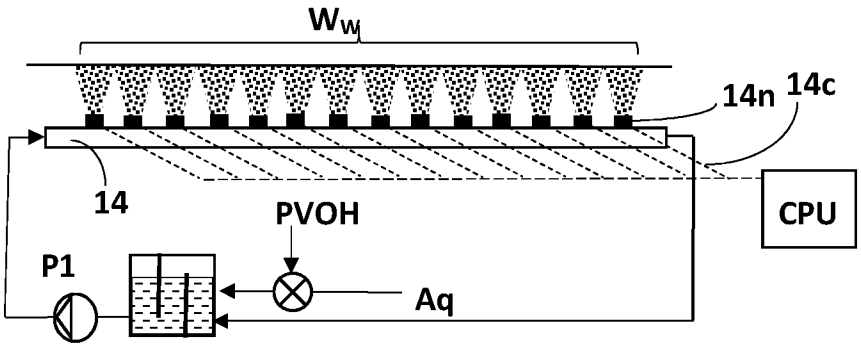
FIG. 2; shows a spray boom for PEM and associated PEM supply system.

In FIG. 2, an embodiment of the PEM supply boom 14 is shown, extending over the entire width $W_W$ of the web. This PEM supply boom may have a multitude of individual PEM supply nozzles 14*n*, each with an individual control valve 14*c* connected to a control unit CPU. The supply nozzles are preferably fan jet nozzles, with fan jets extending with the width of the fan jet across the width of the web. Each fan jet ends when next neighboring fan jet nozzle takes over, thus covering the entire width of the web. The PEM source may be water, the main component in volume, with additives mixed into it, only PVOH (polyvinyl alcohol) shown as an example of the additives added. The high molecular weight polymer added needs a long residence time in the water mixture in order to untangle the long polymeric chains, and the resulting mixture may be feed to a buffer storage as shown in the figure where the residence time may be between 30-240 minutes. Thereafter the PEM mixture is pumped to the PEM supply boom 14 with a pressurizing pump $P_1$. The PEM mixture may also have a return pipe connected to the buffer storage, allowing a developed flow along the entire length of the PEM supply boom which prevents solids in the solution from settling.

Figure 3A:
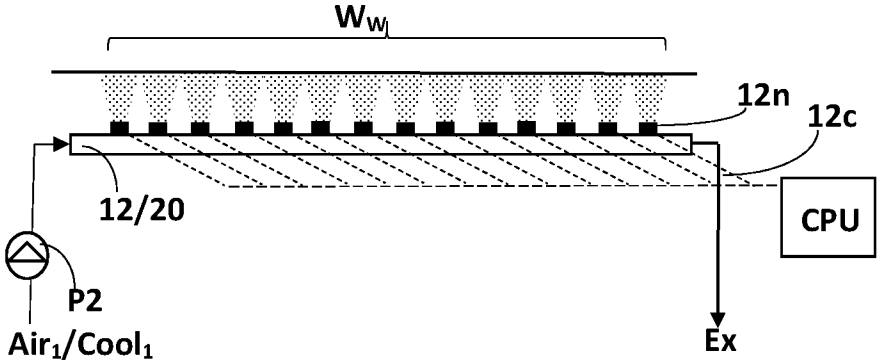
FIG. 3*a*; shows a first embodiment of a distribution boom used in the invention, feeding low moisture air, or additional cooling liquid, onto the outer surface of the Yankee cylinder.

In FIG. 3*a* an embodiment of the distribution boom 12/20 is shown, extending over the entire width $W_W$ of the web. The same kind of distribution boom may be used both for distributing low moisture air as well as cooling liquid. What is later on described for the low moisture air boom 12 applies as well for a cooling liquid boom 20.

The low moisture air boom 12 is similar in all examples with references 12*a*, 12*b*, both of them arranged after the PEM spray boom 14, or 12*c*, 12*d* and 12*e*, all of these arranged ahead of the PEM spray boom 14.

This low moisture air boom 12 may have a multitude of individual low moisture air supply nozzles 12*n*, each with an individual control valve 12*c* connected to a control unit. The supply nozzles 12*n* are preferably fan jet nozzles, with fan jets extending with the width of the fan jet across the width of the web. The fan jet ends when next neighboring fan jet take over, thus covering the entire width of the web.

The low moisture air source $Air_1$ may be ambient air.

In the case where ambient air is used as low moisture air source, the velocity of the cooling air is regulated by pressure in the supply boom. Test with air as coolant have shown that the required pressure in the supply boom should be in the range of 2 kPa only, and the required air volume in the range of 175 $m^3$/min for a 200 inch (in web width) tissue machine The low moisture air is pumped with a pressurizing pump $P_2$ to the low moisture air boom 12 at increased pressure. As shown here, a part of the low moisture air supplied to the low moisture air boom 12 may be exhausted through a pipe Ex in the other end, for example if ambient air is used, but this exhaust pipe may be closed if more expensive coolant is used.

Figure 3B:
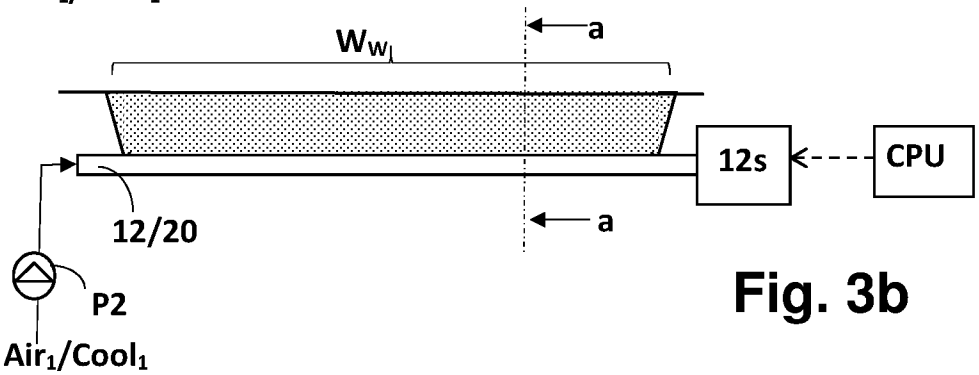
FIG. 3*b*; shows a second embodiment of a distribution boom used in the invention, feeding low moisture air, or additional cooling liquid, onto the outer surface of the Yankee cylinder.
Figure 3C:
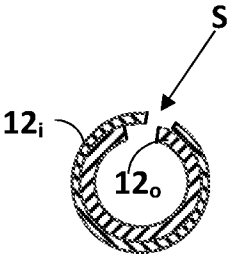
FIG. 3*c*; shows a cross section of the distribution boom used in the second embodiment as seen in the view a-a in FIG. 3*b*.

In FIG. 3*b* an alternative embodiment of the low moisture air boom 12 is shown which extends over the entire width $W_W$ of the web. This low moisture air boom may have a single continuous slot S (as shown in FIG. 3*c*). The supply slot S is shown in FIG. 3*c* as seen through the cross-section view a-a in FIG. 3*b*. The slot width, and thus the low moisture air supply rate, may be controlled by a control unit CPU by a servo unit 12*s* that rotates one of the inner or outer coaxial pipe members 12*i* or 12*o* in relation to each other. In tests performed with air as coolant, a slot width of about 10 mm was used and the entire cooling boom could be adjusted changing the direction of the slot. The slot establishes a continuous flat flow of low moisture air over the entire width $W_W$ of the web. In this embodiment an exhaust pipe is not used.

Figure 5:
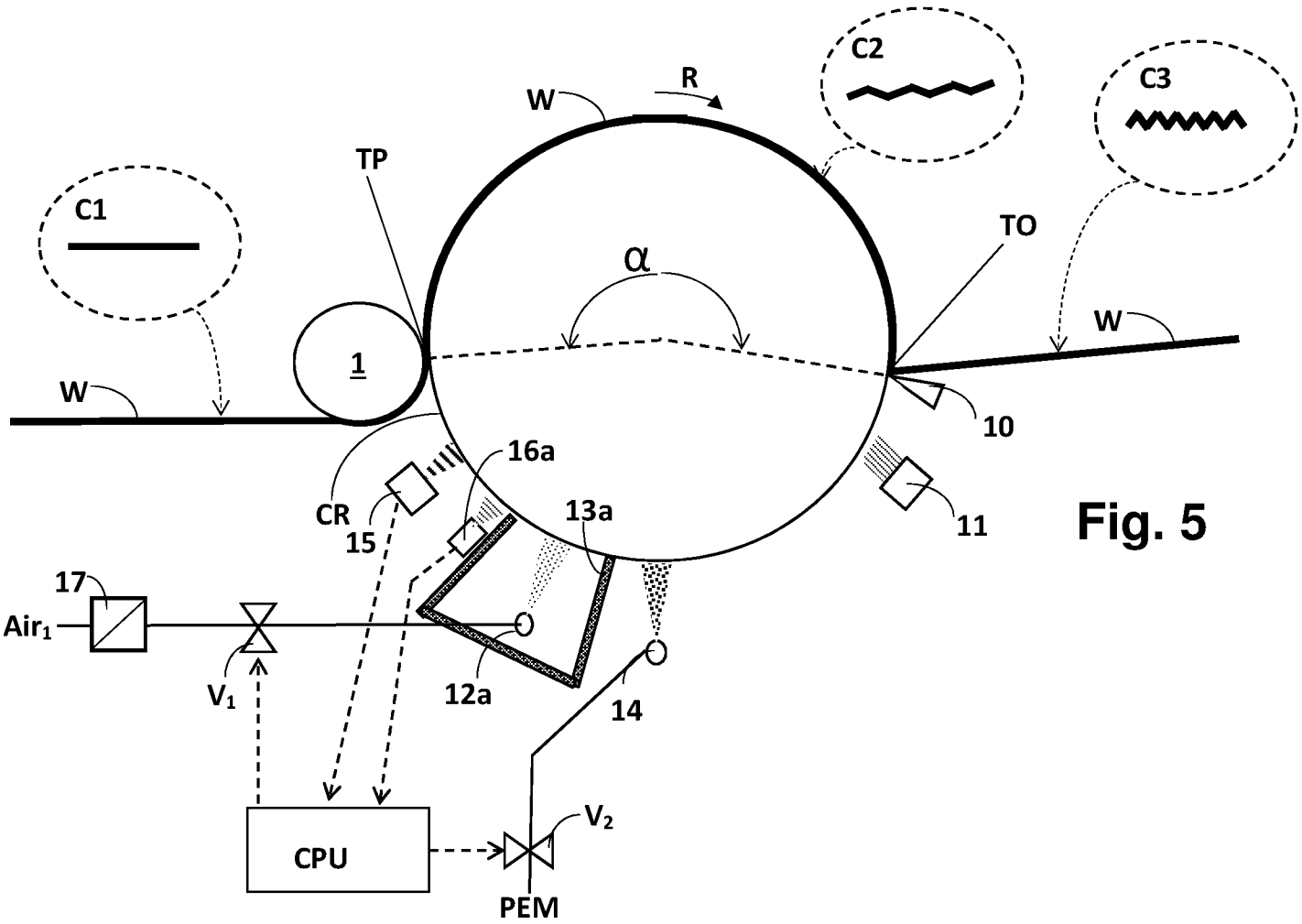
FIG. 5; shows a schematic side view of a second embodiment of the invention in the same side view as in FIG. 1 with cooling of the PEM coating after application of the coating.

In FIG. 5, a second embodiment of the invention is shown. In relation to the first embodiment shown in FIG. 1 the moisture-controlled environment is shielded on at least 3 sides of the moisture-controlled environment and said moisture-controlled environment opens towards the exposed outer cylindrical surface of the Yankee cylinder CR. This will assure that the low moisture air supplied into the moisture-controlled environment will flow towards the surface of the Yankee cylinder, and that the flow of low moisture air supply will not disturb the preceding application of a PEM layer.

Figure 6:
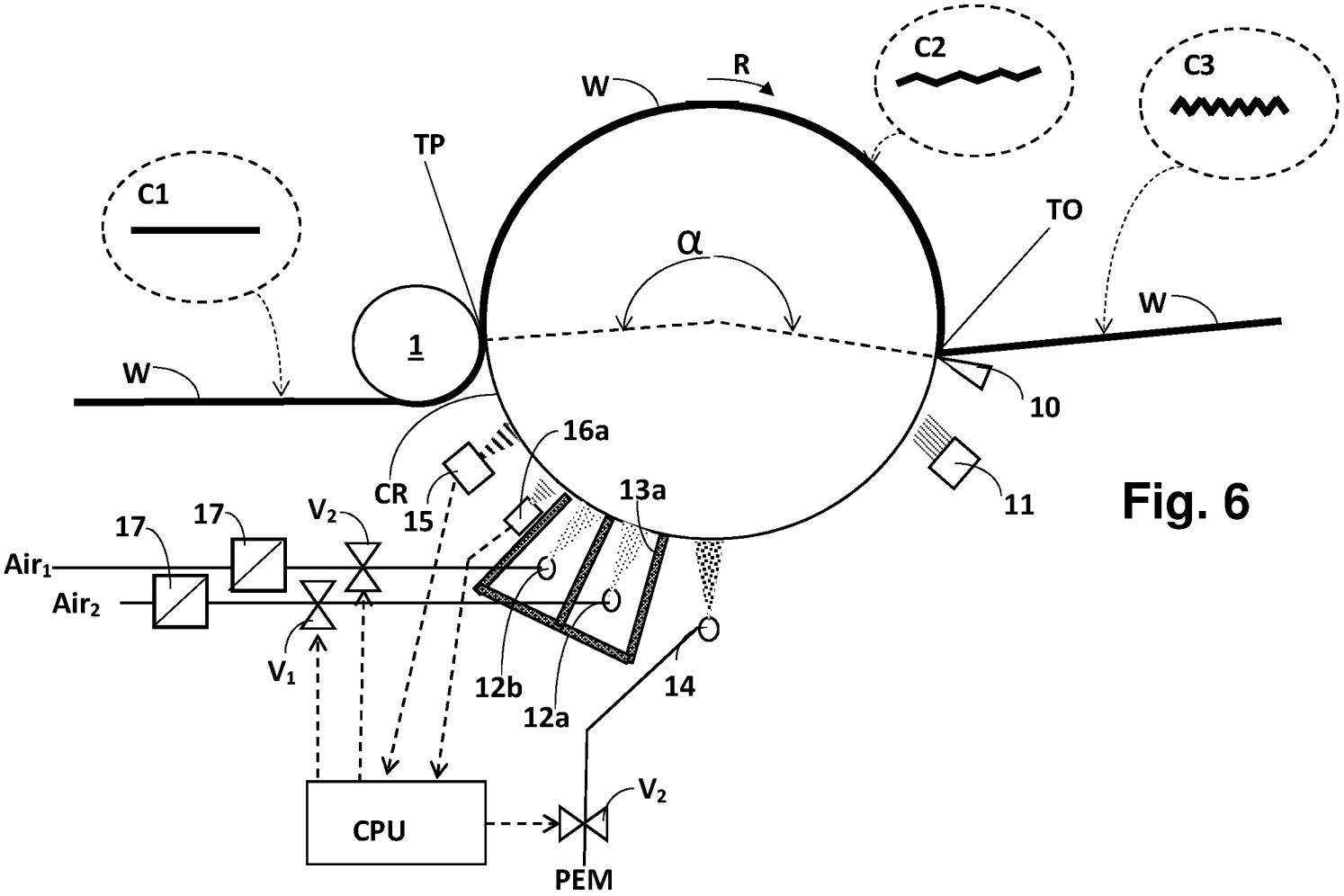
FIG. 6; shows a schematic side view of a third embodiment of the invention in the same side view as in FIG. 1 with cooling of the PEM coating after application of the coating.

In FIG. 6, a third embodiment of the invention is shown. In relation to the first embodiment shown in FIG. 1 this embodiment is arranged with two low moisture air booms 12*a* and 12*b* respectively that are connected to two independent low moisture air sources. One of the low moisture air sources may be ambient air and the other cooled air from the tissue machine hall. The valves in the supply pipes may be controlled in the same manner as in the first embodiment.

Figure 7:
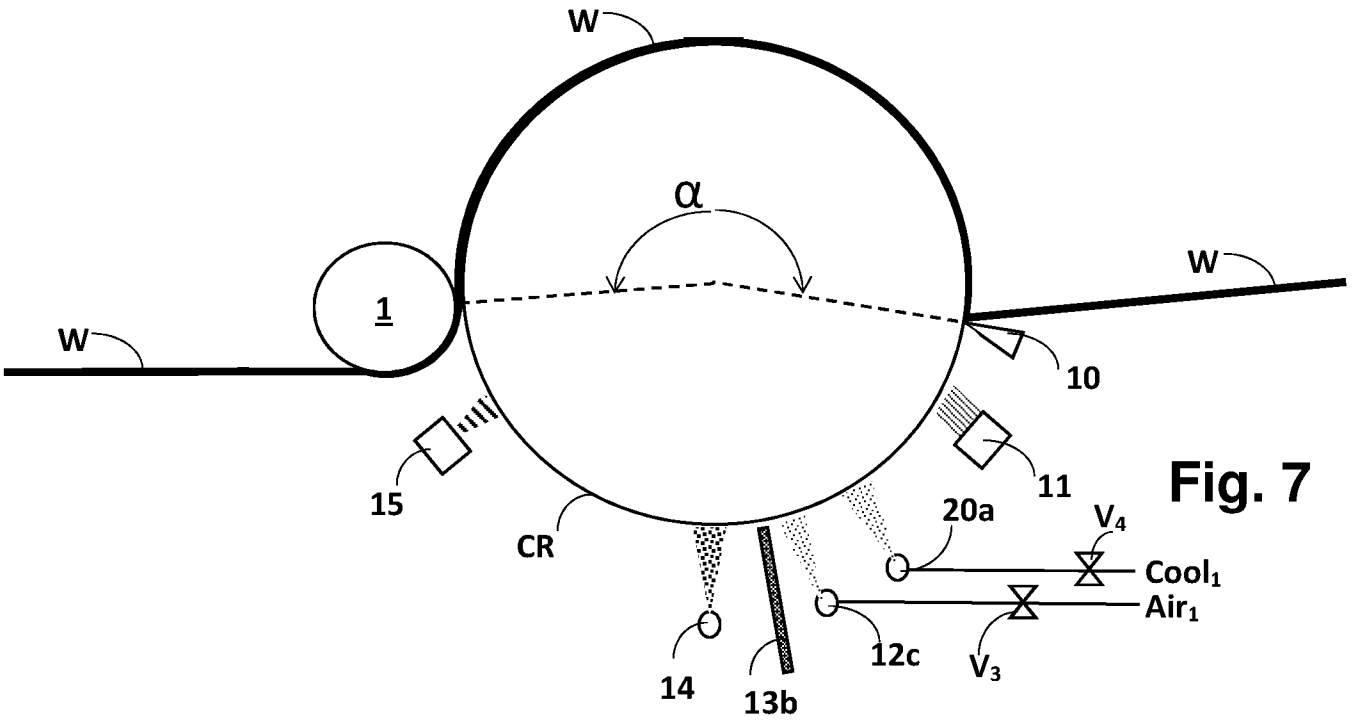
FIG. 7; shows a schematic side view of a fourth embodiment of the invention in the same side view as in FIG. 1 but with cooling liquid applied onto the Yankee cylinder and subsequent increase evaporation rate in a low moisture zone before application of the PEM coating.

In FIG. 7, a fourth embodiment of the invention is shown. In contrast to embodiments shown in FIGS. 1, 5 and 6 this embodiment includes usage of an additional cooling boom 20*a* that applies a liquid coolant on the surface of the Yankee, said applied liquid thereafter evaporated in the subsequent moisture-controlled environment established by a low moisture air boom 12*c* arranged after the cleaning device 11 and the cooling boom 20*a*, as seen in the rotational direction R of the Yankee cylinder. This low moisture air boom 12*c* is connected to a low moisture air source $Air_1$, and with a control valve $V_3$ arranged in the supply pipe connected to the low moisture air boom 12*c*. This creates a moisture-controlled environment cooling the exposed surface of the Yankee cylinder having the liquid coolant layer. This provides for an evaporative cooling of any residual PEM coating that is left on the Yankee cylinder after the doctor blade. The residual PEM coating may then be cooled by evaporation of the applied liquid layer before application of new fresh PEM coating. A shield wall 13*b* is preferably arranged after the moisture-controlled environment, and a temperature sensor 16*b* may be arranged on the shield wall 13*b*. This temperature sensor may preferably be connected to a control unit $CPU_1$ that may control the supply of the low moisture air by regulating the control valve $V_3$ and control the supply of liquid coolant by regulating the control valve $V_4$.

After the moisture-controlled environment, a PEM supply boom 14 is arranged. The fresh PEM is thus applied on a cooler surface of the Yankee cylinder, and the residual PEM layer is prevented from turning glassy due to the evaporation of the liquid layer applied on top of the residual PEM layer.

Finally, after the application of the PEM coating a thickness sensor 15 may be arranged, that may detect the thickness of the coating applied. This thickness sensor 15 may preferably be connected to a control unit $CPU_2$ that may control the supply of the PEM coating by regulating the control valve $V_2$. In practice a common control unit may be used that control both thickness and temperature.

Figure 8:
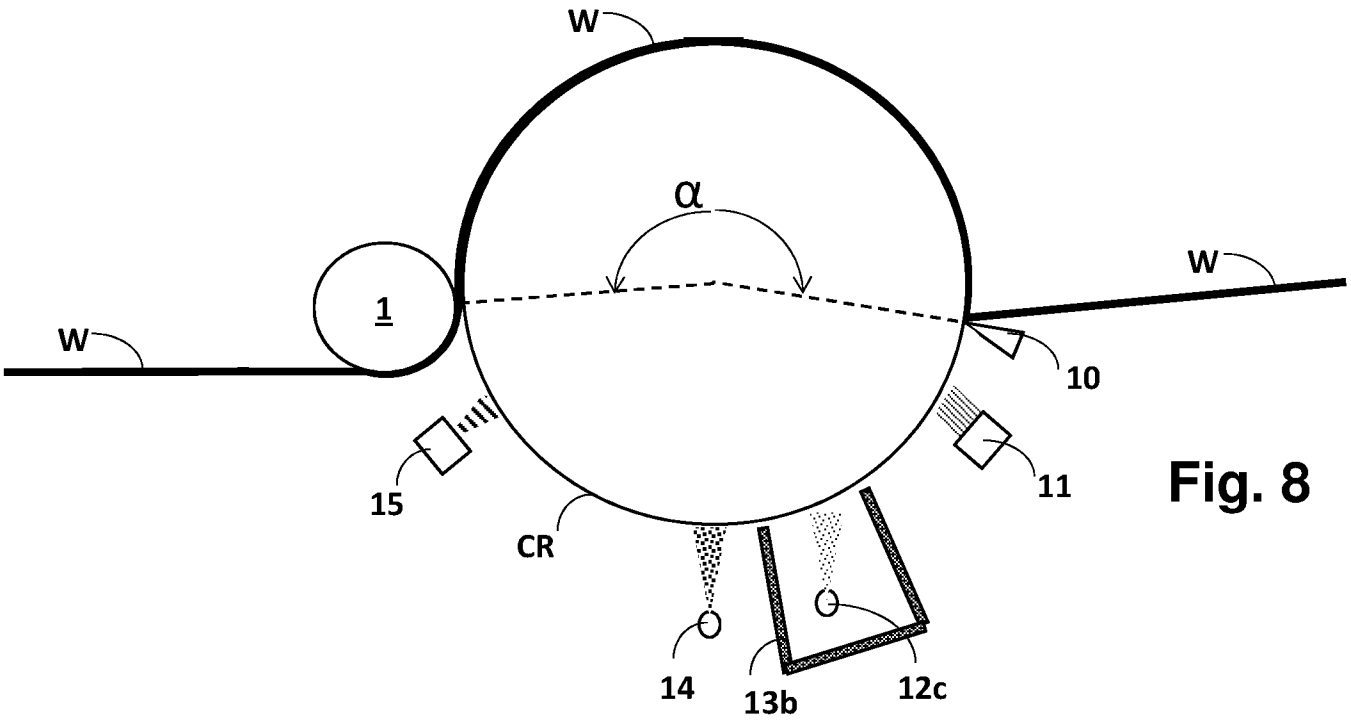
FIG. 8; shows a schematic side view of a fifth embodiment of the invention in the same side view as in FIG. 7 with a shielded low moisture zone before application of the PEM coating.

In FIG. 8 is shown a fifth embodiment of the invention. In relation to the embodiment shown in FIG. 7 the moisture-controlled environment is shielded on at least 3 sides of the moisture-controlled environment and said moisture-controlled environment opens towards the exposed outer cylindrical surface of the Yankee cylinder CR. This will ensure that the low moisture air supplied into the moisture-controlled environment will flow towards the surface of the Yankee cylinder, and that the flow of coolant supply will not disturb the following application of a PEM layer.

Figure 9:
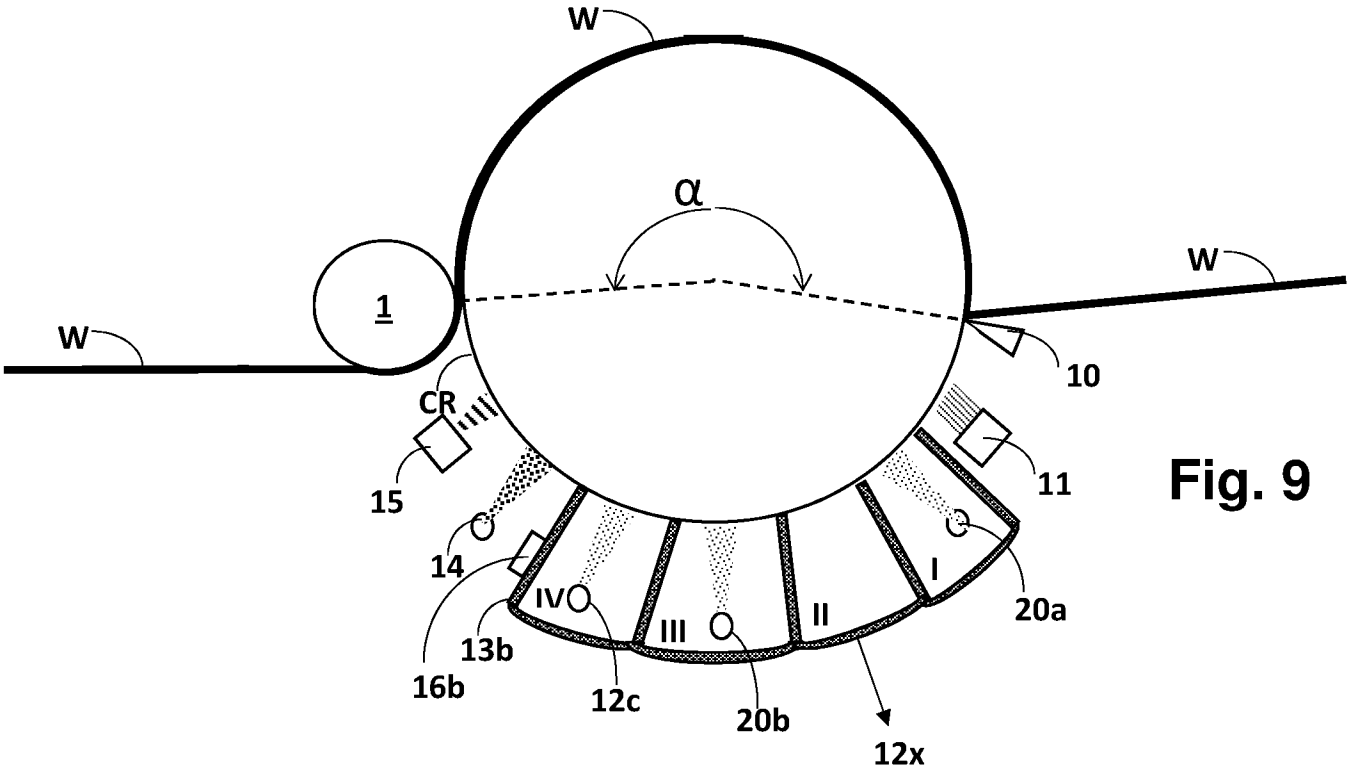
FIG. 9; shows a schematic side view of a sixth embodiment of the invention in the same side view as in FIG. 7 with multiple shielded zones before application of the PEM coating.

In FIG. 9, a sixth embodiment of the invention is shown. In relation to the embodiment shown in FIG. 7, the moisture-controlled environment is divided into 4 individually shielded zones I-IV.

In the first zone I a first cooling boom 20*a* may be located, preferably distributing a cooling liquid in mist form with a temperature of the cooling liquid close to the evaporation temperature.

In the second zone II an evacuation pipe 12*x* may be connected to low pressure, especially if the cooling liquid supplied in the preceding zone is liquid. The evacuation will lower the pressure and assist in evaporation and evacuation of evaporated residual cooling liquid.

In the third zone III a second cooling boom 20*b* may be located, preferably distributing a cooling liquid.

Finally, in the fourth zone IV a third low moisture air boom 12*c* may be located, preferably distributing a low moisture air.

This sequential cooling in successive zones may be implemented if the cooling effect is to be optimized, wherein each individual cooling zone in the moisture-controlled environment may be individually regulated for highest possible cooling effect. Each successive cooling zone is shielded on at least 3 sides of each zone of the moisture-controlled environment and said moisture-controlled environment open towards the exposed outer cylindrical surface of the Yankee cylinder CR. This will ensure that the low moisture air supplied into the moisture-controlled environment as well as cooling liquid will flow towards the surface of the Yankee cylinder, and that the flow of low moisture air as well as coolant supply will not disturb each other as well as the following application of a PEM layer. Each zone may also be closed by walls (not shown) in their gable ends (the outer ends at the ends of the web width), possibly with evacuation ducts for coolant excess or evaporated moisture in said gable ends.

Figure 10:
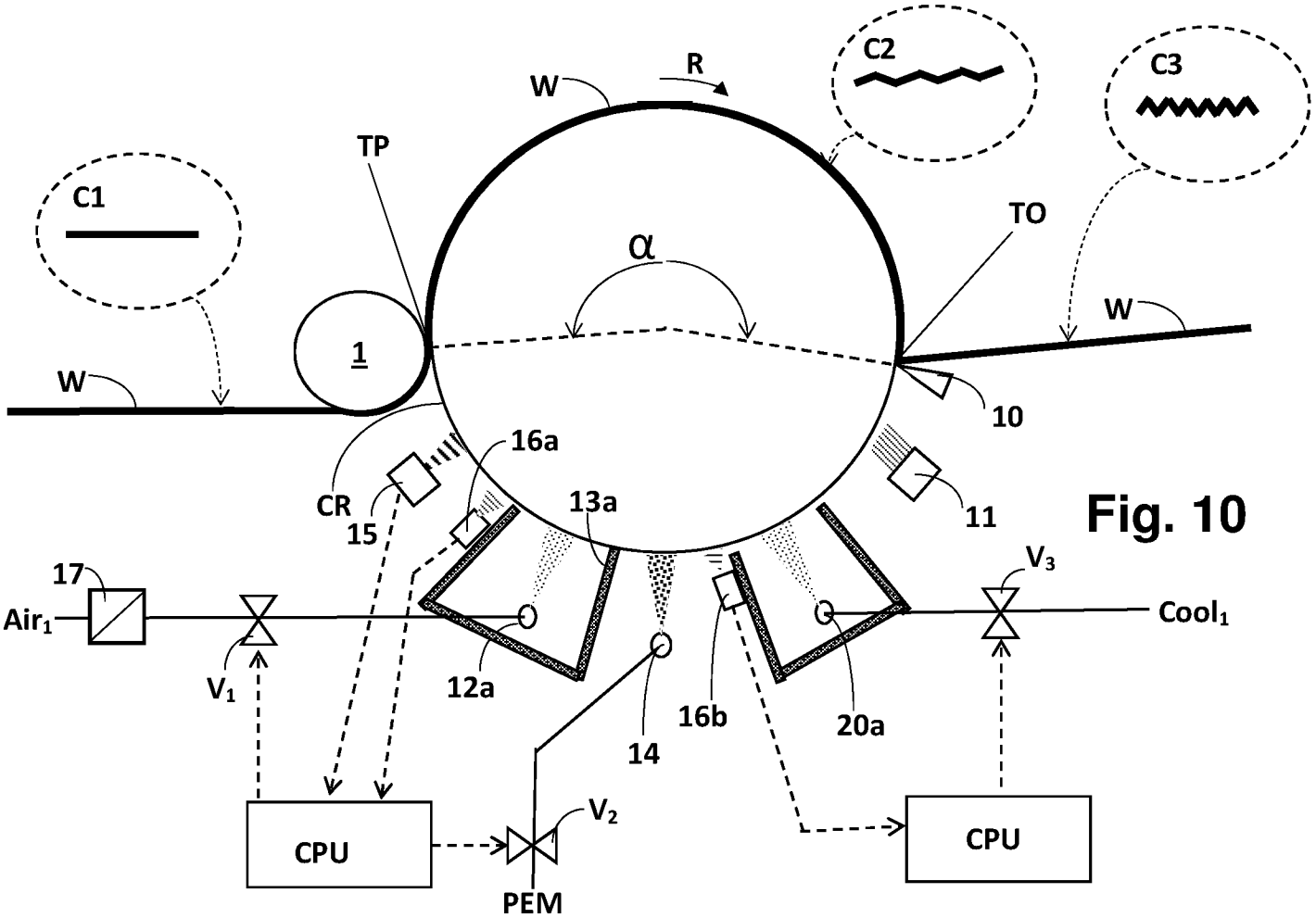
FIG. 10; shows a schematic side view of a seventh embodiment of the invention in the same side view with a shielded zone with application of cooling liquid on the Yankee cylinder before application of the PEM coating as well as a shielded low moisture zone whit increased evaporation effect after the application of the PEM coating.

Finally, in FIG. 10, a seventh embodiment of the invention is shown. In this embedment is a first shielded cooling zone with application of liquid, preferably water, to be evaporated arranged before the PEM spray boom 14, and one shielded moisture-controlled environment arranged after the PEM spray boom 14. Each respective zone is controlled as shown in preceding embodiments, using temperature sensors 16*a*, 16*b* after each zone and a final PEM thickness measurement 15.

The embodiments shown implement at least one moisture-controlled environment immediately after the PEM spray boom or a moisture-controlled environment immediately ahead of the PEM spray boom. Both moisture-controlled environment zones reduce heating of the PEM coating and the PEM coating will have a lower temperature when reaching the transfer point where the tissue web is applied onto the PEM coated surface of the Yankee cylinder. This will reduce viscosity of the PEM coating and reduce PEM coating from diffusing into the tissue web.

The best effect is obtained from cooling the surface of the PEM coating after the PEM spray boom and using air as the coolant. The water content in the PEM coating when reaching the transfer position should be as low as possible, as high water content in the PEM coating in transfer position may reduce wet tack and web/sheet transfer to the Yankee cylinder will be poor and uneven. This will cause uneven crepe structure and wavy diameter in the final pick up roll.

However, liquid may be used as coolant especially in the cooling zones preceding the PEM spray boom. As the PEM mixture per se contains typically +90% water, no negative impact will occur if water residues are left on the Yankee cylinder surface when applying the PEM coating. On the contrary, if the water content is increased somewhat the maximum coating temperature of 100° C. will be maintained longer as long as there is water in the PEM coating to be evaporated.

Small amounts of water added after applying the PEM coating, for example as a mist, is acceptable if these amounts have time to evaporate before the transfer position.

The basic feature of the invention is the application of a moisture-controlled environment with lower moisture level than normal. This improves evaporation rate in the PEM coating. This could be made as one or more individual zones all having a moisture-controlled environment.

The moisture-controlled environment may be established in the simplest embodiment by blowing air from the machine hall into the area beneath the Yankee, said air having a much lower temperature than the temperature without supplying this replacement air.

The replacement air may alternatively be recirculation of the air in this environment through a dehumidifier that condenses most of the humidity before reintroduction. It may also be replacement air that is additionally cooled by coolers before being supplied.

However, less relative humidity is essential. The replacement air may also be heated such that the moisture level drops at least 20%, but colder air is preferred.

When the relative humidity in the moisture-controlled environment has been lowered may an increase in the evaporation effect be obtained by adding water to the PEM coating, which may guarantee that the temperature of the PEM coating stays below 100° C. As long as there is water in the PEM coating the temperature will stay below 100° C. as this is the evaporation temperature of water.

DRAWINGS CATALOGUE

1 Transfer Roll
10. Doctor Blade
11. Cleaning Device
12 Cooling boom
12*n* cooling boom nozzle
12*c* cooling nozzle valve
12*o* Outer tube in boom
12*i* Inner tube in boom
12*a* First air cooling boom after PEM application
12*b* second air cooling boom after PEM application
12*c* First cooling boom ahead of PEM application
12*d* Second cooling boom ahead of PEM application
12*e* Third cooling boom ahead of PEM application
12*x* Evacuation pipe
13*a* Shield wall PEM cooling/13*b* Shield wall precooling
14 PEM spray boom
14*n* PEM nozzles
14*c* PEM nozzle valve
15 Thickness sensor
16 Temperature sensor
17 Conditioner
CR Creping roll
W Tissue web
$W_W$ Tissue web width
α The web angle wrap
TP Transfer Position
TO Take-off Position
R Direction of rotation
S Slot
$V_1$ Control valve after PEM application
$V_2$ Control valve after PEM application
$V_3$ Control valve ahead of PEM application
$V_4$ Control valve ahead of PEM application
$Air_1$ Second air source
$Air_2$ Second air source
$Cool_1$ First Cooling media
$Cool_2$ Second Cooling media
CPU1/CPU2 Control Units cool/PEM

The invention claimed is:

1. A method of controlling environmental moisture in a way that influences the application of a coating containing a water solution of a Performance Enhancing Material (PEM) on a surface of a Yankee cylinder ahead of a Transfer Position (TP) of a tissue web onto the Yankee cylinder, the method comprising:

taking off dried and creped tissue web (W) from the Yankee cylinder (CR) in a take-off position (TO) via a doctor blade (10);

applying a coating containing a water solution of a Performance Enhancing Material (PEM) onto the Yankee cylinder (CR) at an Application Position (AP) arranged after the take-off position; and establishing at least one partially shielded moisture-controlled environment between the take-off position (TO) and the Transfer Position (TP) of the tissue web onto the Yankee cylinder, said partially shielded moisture-controlled environment extending across an entire width of the tissue web and having a controlled relative humidity that is at least 20 percentage units lower than a relative humidity absent the at least one partially shielded moisture-controlled environment between the take-off position (TO) and the Transfer Position (TP) of the tissue web onto the Yankee cylinder, whereby the established partially shielded moisture-controlled environment contributes to cooling a surface of the coating containing the water solution of the Performance Enhancing Material (PEM) applied onto the Yankee cylinder in the moisture-controlled environment, thereby increasing an evaporation rate of water in or applied onto the Performance Enhancing Material (PEM).

2. The method according to claim 1, wherein a first coolant is added into the moisture-controlled environment.

3. The method according to claim 2, wherein the first coolant is distributed continuously over the entire width of the Yankee cylinder.

4. The method according to claim 3, wherein the coolant is distributed over the entire width ($W_W$) of the Yankee cylinder using a slot (S) or multiple nozzles (12*n*) arranged over the entire width of the Yankee cylinder.

5. The method according to claim 4, wherein the slot (S) has a slot gap (S) that is adjustable or each of the multiple nozzles (12*n*) are adjustable.

6. The method according to claim 1, wherein the at least one partially shielded moisture-controlled environment is shielded on at least three sides of the moisture-controlled environment and said moisture-controlled environment is open towards the exposed oater cylindrical surface of the Yankee cylinder (CR).

7. The method according to claim 2, wherein a second coolant used is a liquid coolant applied onto the outer cylindrical surface of the Yankee cylinder, which liquid coolant is evaporated in said moisture-controlled environment after being applied onto the outer cylindrical surface of the Yankee cylinder ahead of the moisture-controlled environment.

8. The method according to claim 5, wherein at least two different coolants are used in the moisture-controlled environment in at least two different zones of the moisture-controlled environment.

9. The method according to claim 1, wherein the temperature on the surface of the Yankee cylinder is measured after the moisture-controlled environment and the coolant supply is controlled in order reach a target temperature.

10. The method according to claim 9, wherein the temperature in the moisture-controlled environment lowered at least 20° C. compared to not using a moisture-controlled environment, and establishing a temperature of the moisture-controlled environment within the range 20-80° C.

11. A system of controlling environmental moisture in a way that influences the application of a coating containing a Performance Enhancing Material (PEM) on a surface a Yankee cylinder ahead of the transfer position (TP) of a tissue web onto the Yankee cylinder, the system comprising:

a doctor blade (10) taking off dried and creped web (W) from the Yankee cylinder (CR) in a take-off position (TO);

an application position (AP) of a coating containing a water solution of a Performance Enhancing Material (PEM) onto the Yankee cylinder, the application position (AP) being arranged after the take-off position; and at least one partially shielded one moisture-controlled environment arranged between the take-off position (TO) and the transfer position (TP) of the tissue web onto the Yankee cylinder by supplying low moisture air from a low moisture air source to the moisture-controlled environment, wherein said at least one partially shielded moisture-controlled environment extends across an entire width of the tissue web and has a controlled relative humidity that is at least 20 percentage units lower than a relative humidity absent the at least one partially shielded moisture-controlled environment between the take-off position TO and the Transfer Position (TP) of the tissue web onto the Yankee cylinder, thereby cooling a surface of the coating containing the water solution of the Performance Enhancing Material (PEM) applied onto the Yankee, and thereby increasing evaporation rate of water in or applied onto the Performance Enhancing Material (PEM).

12. The system according to claim 11, wherein the low moisture air source ($Air_1$, $Air_2$) is air taken from the machine hall of the Yankee cylinder or air taken externally from the machine hall of the Yankee cylinder.

13. The system according to claim 11, wherein a coolant ($Cool_1$, $Cool_2$, $Air_1$, $Air_2$) is continuously distributed over the entire width ($W_W$) of the Yankee cylinder (CR) by a distribution boom (12/20), using multiple nozzles (12*n*) or a continuous slot (S) arranged over the entire width of the Yankee cylinder on said distribution boom (12).

14. The system according to claim 13, wherein each nozzle (12*n*) or a slot gap of the continuous slot (S) is adjustable by a control system (CPU, $V_1$, $\mathbf{12}_c$) in order to reach a temperature.

15. The system according to claim 11, wherein the moisture-controlled environment is shielded from the application position (TP) of the Performance Enhancing Material (PEM) onto the Yankee cylinder using at least one shield wall (13*a*/13*b*) located with one end of the shield wall (13*a*/13*b*) at a first distance (d) from the surface of the Yankee cylinder such that the one end of the shield wall does not contact the surface of the Yankee cylinder, and the other end of the shield wall at a second distance (d) exceeding 5 centimeters from the creping roll.

16. The system according to claim 15, wherein the at least one partially shielded moisture-controlled environment is shielded on at least three sides of the moisture-controlled environment and said moisture-controlled environment is open towards the exposed outer cylindrical surface of the Yankee cylinder (CR).

17. The system according to claim 11, wherein a coolant source ($Cool_1$, $Cool_2$) is a liquid coolant that is applied on the surface of the Yankee cylinder before the application position (TP) of the Performance Enhancing Material (PEM) onto the Yankee cylinder, said liquid coolant increasing the volume of evaporable liquid in a residual layer of Performance Enhancing Material (PEM) left on the Yankee after the doctor blade (10) or second coolant source ($Cool_1$, $Cool_2$) is a liquid coolant that is applied on the surface of the Yankee cylinder after the application position (TP) of the Performance Enhancing Material (PEM) onto the Yankee cylinder, said liquid coolant increasing the volume of evaporable liquid in the Performance Enhancing Material (PEM) applied.

18. The system according to claim 11, wherein at least two different coolant sources ($Air_1$, $Air_2$, $Cool_1$, $Cool_2$) are used in at least two different zones (I, III, IV) of the moisture-controlled environment.

19. The system according to claim 11, wherein a temperature sensor (16*b*) is arranged after the moisture-controlled environment and before the application position of the Performance Enhancing Material (PEM), measuring the temperature on the surface of the Yankee cylinder having passed the moisture-controlled environment or a temperature sensor (16*b*) is arranged after the moisture-controlled environment and after the application position of the Performance Enhancing Material (PEM), measuring the temperature on the PEM coating applied on the surface of the Yankee cylinder having passed the moisture-controlled environment.

* * * * *